US006267066B1

(12) United States Patent
Schickling et al.

(10) Patent No.: US 6,267,066 B1
(45) Date of Patent: Jul. 31, 2001

(54) REFRACTORY TILE SYSTEM FOR BOILER TUBE/HEAT EXCHANGER

(75) Inventors: Jay S. Schickling, Auburn; Dennis M. Tracey, Medfield; Ara M. Vartabedian, Framingham; Jonathan A. Wade, Northborough, all of MA (US)

(73) Assignee: Saint-Gobain Industrial Ceramics, Worcester, MA (US)

( * ) Notice: Subject to any disclaimer, the term of this patent is extended or adjusted under 35 U.S.C. 154(b) by 0 days.

(21) Appl. No.: 09/526,331

(22) Filed: Mar. 15, 2000

(51) Int. Cl.[7] ..... F23M 5/00; F22B 37/06

(52) U.S. Cl. ..... 110/324; 110/325; 110/336; 122/511

(58) Field of Search ..... 122/511, 493; 110/336, 337, 338, 339, 322, 323, 324, 325

(56) References Cited

U.S. PATENT DOCUMENTS

| | | | | |
|---|---|---|---|---|
| 1,176,619 | * | 3/1916 | Sykes | 24/694 |
| 3,048,481 | | 8/1962 | Du Bois Eatman . | |
| 3,828,735 | | 8/1974 | Graham et al. . | |
| 3,850,146 | * | 11/1974 | Graham et al. | 122/6 A |
| 4,317,418 | * | 3/1982 | Courshon, Jr. et al. | 110/331 |
| 4,768,447 | | 9/1988 | Roumeguere . | |
| 4,809,621 | * | 3/1989 | Materna | 110/323 |
| 4,809,645 | | 3/1989 | Fournier et al. . | |
| 5,083,424 | * | 1/1992 | Becker | 60/39.31 |
| 5,107,641 | * | 4/1992 | Davis | 52/127.7 |
| 5,163,831 | * | 11/1992 | Hammond | 432/238 |
| 5,243,801 | | 9/1993 | Aiken et al. . | |
| 5,423,294 | | 6/1995 | Cole et al. . | |
| 5,431,020 | * | 7/1995 | Maghon | 60/753 |
| 5,542,378 | | 8/1996 | Kubiak et al. . | |

FOREIGN PATENT DOCUMENTS

| | | |
|---|---|---|
| 336151 | 3/1959 | (CH) . |
| 9016206 | 2/1991 | (DE) . |
| 0656508 | 6/1995 | (EP) . |
| 0854321 | 7/1998 | (EP) . |
| 0895028 | 6/1999 | (EP) . |
| WO 97/09577 | 3/1997 | (WO) . |

* cited by examiner

*Primary Examiner*—Henry Bennett
*Assistant Examiner*—K. B. Rinehart
(74) *Attorney, Agent, or Firm*—Mike W. Crosby; Sampson & Associates, P.C.

(57) ABSTRACT

A refractory tile system includes a barrier layer coating applied to the wall (membrane and waterwall or tube wall) of a boiler of an incinerator or heat exchanger. Refractory tiles are then fastened to the tube wall utilizing a floating attachment mechanism to provide a relatively high degree of freedom of movement relative to the tube wall to accommodate micro-scale bowing of the tile generated by the relatively large temperature gradient and mean temperature typically experienced by such tiles. Each tile is also effectively isolated from adjacent tiles by providing a predetermined gap therebetween of sufficient size to effectively prevent macro-scale bowing generated by networking thereof. Moreover, a compressible fibrous mortar is preferably disposed in the gap or channel between each adjacent tile to substantially prevent ash or other contaminants from passing therethrough. The gaps or channels between the adjacent tiles are sized in combination with the known compressibility of a particular compressible mortar selected, so as to prevent macro-scaled bowing from occurring when the tiles are disposed in their maximum micro-scale bowed condition.

26 Claims, 16 Drawing Sheets

REFRACTORY TILE SYSTEM FOR BOILER TUBE/HEAT EXCHANGER

BACKGROUND OF THE INVENTION

1. Field of the Invention

The present invention is directed to refractory tube blocks which protect metallic waterwall tubes from hot and highly corrosive furnace gases, while at the same time maintaining good heat conductivity.

2. Background Information

Refractory tiles have long been used for the protection of boiler walls in waste incinerators and other heat exchanger applications. The primary function of the tiles has been to shield the steel alloy boiler walls, which typically include waterwall tubes and membranes or webs disposed therebetween, from the temperature, erosion, and corrosion by acid vapor attack associated with boiler operation. These conditions are generated by the combustion process occurring within the boiler. For example, municipal solid waste (MSW) facilities incinerate trash and garbage in furnaces at temperatures of up to about 1400° C. In order to recover the valuable energy produced in these MSW plants, water is passed through metallic waterwall tubes adjacent to the furnace and converted to steam by the high temperatures. The steam produced in the tube assembly is then used to power a turbine-driven electric generator. However, the MSW plant also produces gaseous products which, if allowed to contact the metal wall, would chemically attack the walls. The purpose of the refractory tiles has been to prevent direct attack of the walls by gaseous products and still allow the tubes to be sufficiently heated to efficiently generate steam. The primary purpose of the tiles is thus to extend tube wall lifetime expectancy.

Refractory tiles for boiler tube protection have traditionally been fabricated from a material such as silicon carbide (SiC). These tiles typically are provided with a substantially planar face with a contoured back surface sized and shaped to match the contour of the tube wall. Such tiles generally have been fabricated as a variant of one of three configurations, namely bolted tiles; hanging tiles, such as disclosed in U.S. Pat. No. 4,768,447 to Roumeguere; and modified hanging tiles also known as slotted or T-slotted tiles such as disclosed in U.S. Pat. No. 5,243,801 to Aiken, et al. and in WO 97/09577 to Zampell Advanced Refractory Technologies, Inc. The U.S. Pat. No. 4,768,447, U.S. Pat. No. 5,243,801 and WO 97/09577 references are fully incorporated by reference herein.

As shown in FIGS. 1 and 2, bolted tiles 10 are generally provided with a square or rectangular face 12 adapted for orientation towards an interior of the boiler. A hole penetrates through the thickness of the tile in the approximate center of the face 12. A countersunk region 34 typically exists within the hole or bore 30 to act as a seat for a nut 28. In a typical installation, a stud or threaded bolt 24 is welded to a membrane region 16 between two tubes 18 in the boiler wall 62. The contoured back surface 14 of the tile 10 includes accurate portions 20 sized and shaped to receivably match the profile of the tube wall 19 and allow for close contact therewith.

The tile is installed by fitting the stud through the hole and securing the tile in position with a washer 28 and nut 26 threaded onto the stud. A cap (not shown) is then typically mortared in place over the hole to minimize the amount of gas that can flow through clearance between the standard hole to the backside of the tile. A layer of mortar (not shown) is typically applied between the tile and the wall 62, and between adjacent tiles, to form a rigid structure which serves to help secure the tile in position and to substantially prevent gas from flowing between and/or behind the tiles.

An advantage of using a bolted tile configuration is that the tiles are relatively easy to install and may be installed on substantially any surface of the boiler, including vertical and overhanging surfaces.

A disadvantage of such bolted tiles is associated with tile failures. These tiles usually have a 2 to 4 year life expectancy due to stud failure. When the studs fail, the tiles tend to fall off of the walls, leaving the boiler tubes exposed to the incinerator atmosphere. The cause of failure in the studs was previously believed to have been due to high temperature acid corrosion. In particular, it was believed that the acids penetrated the tile through the stud hole to attack the stud. The corrosion was believed to be severe on the stud due to its high operating temperature (believed to be 1000° C. or more). Also, cracking of the tiles was a common occurrence, and believed to have been generated by overstressing the stud.

One attempt to address the disadvantages associated with bolted tile systems has included the use of hanging tiles. As shown in FIGS. 3 and 4, hanging tiles 45 typically utilize an anchor/hook or short stud 37 to hang the tile on the membrane 16 of the boiler wall 62, with gravity utilized to maintain the tile in close proximity to the boiler wall 62 for good heat transfer. This tile 45 is a modification of the bolted tile in that one or more holes 30' project from the back surface 14' of the tile toward the hot face 12, but do not fully penetrate the hot face. This provides the tile with a closed face, to theoretically improve acid corrosion resistance. A layer of mortar (not shown) is typically installed between the tile 45 and the boiler wall 62, as well as between adjacent tiles to form a rigid, substantially gas and ash impermeable structure.

A variation of this hanging tile arrangement utilizes the tiles 45 in conjunction with an air sweep system. In this variation, no mortar is installed behind the tiles to leave a gap between the tiles and the boiler wall. A flow of air is fed through this gap to help minimize acid corrosion of the wall.

An advantage of hanging tiles in general is the relative ease of installation and replacement. A disadvantage of such hanging tile arrangements is that the tiles generally cannot be installed on non-vertical walls, as the tiles tend to fall off their anchors. Also, tiles have been known to lift off of their anchors during operation due to thermal expansion, etc. Moreover, the above described air sweep system tends to disadvantageously increase the expense of the tile system relative to configurations utilizing mortar. Heat transfer between the tiles and wall also may be disadvantageously reduced due to the insulative (i.e., relatively low thermal conductivity) characteristic of air layers.

Turning to FIG. 5, modified hanging tiles 50 have been developed in an attempt to address the drawbacks associated with the hanging tiles becoming dislodged from their anchors or hooks. Examples of such modified configurations are commonly known as mushroom bolt, tube-welded fin anchor, and T-slot tiles. These tiles 50 are typically hybrids of bolted tiles and hanging tiles, incorporating a closed tile face 12' with an anchor 52 that has a substantially T-shaped profile, to effectively capture the tiles and allow them to be installed on both vertical and overhanging surfaces.

These tiles 50 are generally installed with a layer of mortar between the tile and the boiler wall, as well as between adjacent tiles. The purpose of the mortar is to help secure the tiles by providing a rigid attachment and to provide a barrier to resist penetration of ash and corrosive gas between and behind the tiles.

An advantage of these modified tiles 50 is that they may be installed on nominally any boiler surface. Disadvantages of the tiles 50 include difficulty of manufacture since they incorporate a blind (i.e., discontinuous) slot 54 projecting laterally into the tile from an edge thereof. Also, the tiles may be physically weaker due to the complexity of the blind slots 54. Moreover, individual tiles generally cannot be replaced without removing a entire row of tiles.

An additional approach intended to address the drawbacks of the above-described configurations has included use of the hanging tiles 45 in combination with a resilient material 48 installed between opposed recesses or grooves 49 as shown in FIGS. 3 and 4. This approach tends to facilitate installation and replacement of the tiles relative to tile systems utilizing conventional rigid mortar. While this approach may operate satisfactorily in some applications, the resilient material 48 disadvantageously provides little resistance to corrosive gas flow and thus tends to be undesirable for use in particularly corrosive environments such as found in MSW boilers.

Still further, many of the approaches discussed hereinabove utilize a fibrous compressible material or mortar at periodic tile intervals to serve as expansion joints. For example, such material may be used every 7 to 15 tiles in a manner familiar to those skilled in the art of masonry (i.e., such as commonly utilized in fabrication of concrete sidewalks, etc.) These joints however, tend to disadvantageously permit the passage of acids and other corrosive materials therethrough, to enable corrosion of the underlying boiler wall. Additionally, the useful life of tile systems having such expansion joints have not been shown to be appreciably greater than similar tile configurations not having such expansion joints.

Thus, a need exists for an improved refractory tile system that addresses drawbacks associated with the prior art.

SUMMARY

A significant aspect of the present invention is the recognition of the problem responsible for many of the failures of the prior art systems. It was recognized that these failures were generated by both bowing of individual tiles (as used herein, "micro-scale" bowing) and collective owing of multiple tiles (as used herein, "networked" or "macro-scale" bowing) as shown in FIG. 8. Referring to FIG. 9, micro-scale bowing generates forces F which transfer through the rigid mortar (not shown) to adjacent tiles to thus generate a macro-scale bowing effect. The macro-scale bowing applies sufficient tensile stress to the studs to cause failure. In this regard, it was heretofore believed that any significant dimensional instability of the tiles was primarily limited to thermal expansion generated by exposure to elevated boiler temperatures. Moreover, it was believed that any bowing was limited to individual tiles.

Contrariwise, the present invention is based on the recognition that thermal gradients experienced by individual tiles during boiler operation (i.e., the difference between the temperature at the hot face 112' and the back 114' as shown, for example, in FIG. 7) were greater than previously suspected, and exerted a greater influence on the dimensional instability of the tiles than the aforementioned thermal expansion. It was then realized that bowing generated by the thermal gradient tended to transfer stresses through the rigid mortar disposed between adjacent tiles to effectively magnify the effects of individual tile bowing as a function of the square of the length of the tile network. This phenomenon is described by the following equation:

$$\delta=\alpha L^2\Delta T/(8t)$$

where $\delta$=cumulative deflection, $\alpha$=the coefficient of thermal expansion, L is the length of the tile array, $\Delta T$ is the difference between temperatures at opposite faces of the tiles and t is the tile thickness.

It has also been discovered that oxidation on the hot face on the tiles occurring over time creates "hot spots" which tend to exacerbate the temperature gradient across the tile to further contribute to the micro-scale bowing effect. In this regard, it has been found that the macro-scale bowing serves to accelerate the oxidation, thus initiating a self-perpetuating cycle that serves to accelerate the decay of the tiles. For example, optimum operating temperature of the hot ace of SiC tiles may be approximately 500 to 600 degrees C. Oxidation at this temperature has been found to be minimal and to not substantially affect tile life. However, it has been found that oxidation progresses rapidly in the event the hot face reaches or exceeds about 750 degrees C and continues to accelerate rapidly as the temperature increases further. An aspect of the present invention was thus the recognition that the macro-scale bowing serves to separate the tiles from the boiler wall, forming an air gap which generally reduces the heat transfer from the back of the tile to the wall. This decrease in heat transfer effectively increases the temperature at the hot face beyond the preferred operating temperature range. The macro-scale bowing eventually has the effect of raising the hot face temperature to the oxidation promoting temperature of 750 degrees C or more. The oxidation in turn, tends to further increase the temperature gradient which as discussed hereinabove, tends to further exacerbate the macro-scale bowing, thus forming a self-perpetuating, deleterious cycle.

Thus, as prior art tile configurations have been developed to minimize acid penetration (i.e., the blind hole mounting of hanging and modified tiles 45 and 50), they have neither identified, nor addressed the aforementioned bowing condition. These prior configurations continue to make use of rigid mortar around the tiles, to thus permit macro-scale bowing to occur.

It was similarly realized that the failure of the above-referenced expansion joints to generate any substantial benefit was due in part to the failure to recognize the networked bowing phenomena and rather attempt to compensate only for relatively benign thermal expansion effect. This failure is indicated not only by the relative paucity or infrequency of the expansion joints (i.e., utilized only once every 7–15 tiles), but also by the frequent use of conventional mortar disposed within at least a portion of the expansion joint.

Initial steps in developing the present invention included completion of a first finite element model (FEM) of a conventional 18 cm×18 cm bolted tile to assess the cause of cracking in the tiles during operation. This analysis revealed the presence of stresses in the tile due to thermal gradients. It also revealed that the individual tiles bow as a function of the thermal gradients. The initial result of this analysis was to increase the thickness of the tile to increase the tile strength.

After this first analysis was completed, a second finite element model was completed to predict the thermal profiles through the tile thickness and along the length of the stud. At an assumed incinerator operating temperature of 1370° C., this model predicted that the studs were operating at temperatures above 800° C., which is the maximum use temperature for most stainless steel.

Failed studs were then retrieved from an incinerator. Analysis of the studs revealed that they had been stretched approximately 6 mm prior to failure. This indicated that the studs were placed under a tensile load, and thus were not failing by acid corrosion alone, but rather by stress-corrosion. It was thus determined to examine the cause of the stress on the studs.

Moreover, during retrieval of the failed studs, it was observed that blistered areas of tiles existed. These blisters were approximately 10 tiles by 10 tiles in area, and were displaced into the boiler.

A third finite element model was initiated to study the phenomenon of tile bowing and tensile stress. As previously mentioned, the first FEM indicated that bowing of individual tiles, or micro-scale bowing, occurred due to thermal gradients. This bowing, however, was of insufficient magnitude (0.3 mm) to have caused the 6 mm deformation observed in the studs.

In the third FEM, a 7 by 7 array of tiles was modeled, assuming that the mortar would act as a rigid material. The results of the analysis indicated a networking effect among the tiles which generated a significant bow of over 25 mm. Additionally, stress analysis indicated that the networked (macro-scale) bowing applied sufficient tensile force to the studs to cause them to stretch to the fracture point.

To confirm the finite element model, a test panel of instrumented tiles was installed in an incinerator. Data collected from the test panel indicated that the tiles bow on a macro-scale during operation, with the magnitude of the bow being approximately 4 mm after 1 year in service. Extrapolation of the rate of bowing indicates that the tile will displace 8 mm (the displacement assumed to be necessary for stud failure) approximately 2.5 years from the start of the test. This corresponds well with the previous service lifetime observations from bolted tiles.

Thus, according to an embodiment of this invention, a refractory tile system for use on a wall of a boiler includes a plurality of tiles having a floating fastener system engagable with the wall to maintain the tiles in spaced, movable relation to one another. The tiles are sized and shaped to provide a gap between adjacent ones of the tiles, the gap being sufficient to accommodate dimensional changes of the tiles exhibited during exposure to operational temperatures of the boiler. A corrosion barrier is disposed between the tiles and the wall.

In a second aspect of the present invention, a refractory tile system for use on a wall of a boiler includes a plurality of tiles disposed on the wall in spaced, movable relation to one another. The tiles are sized and shaped to provide a gap between adjacent ones of the tiles, the gap being sufficient to substantially prevent macro-scale bowing of the tiles during exposure to operational temperatures of the boiler. A corrosion barrier is disposed between the tiles and the wall to substantially prevent corrosion of the wall.

In a third aspect of the subject invention, a method is provided for increasing the useful life of a wall of a boiler. The method includes the steps of:

(a) providing a plurality of tiles having a floating fastener system engagable with the wall to maintain the tiles in spaced, movable relation to one another;

(b) sizing and shaping the tiled to provide a gap between adjacently wall-mounted ones of the tiles, the gap being sufficient to accommodate dimensional changes of the tiles exhibited during exposure to operational temperatures of the boiler;

(c) disposing a corrosion barrier on the wall; and (d) engaging the floating fastener system with the wall, wherein the tiles are superposed with the wall with the corrosion barrier disposed therebetween.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
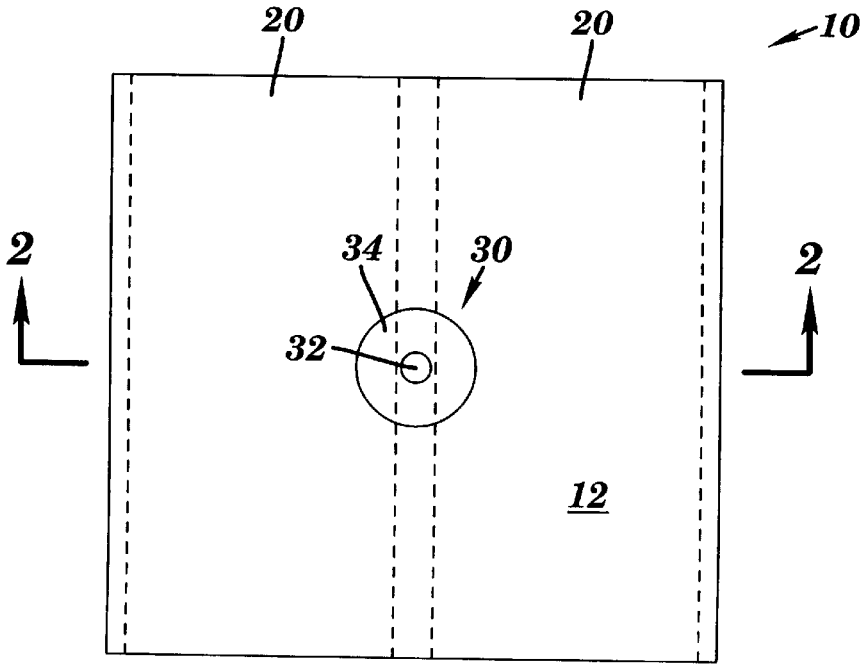
FIG. 1 PRIOR ART
FIG. 1 is a plan view of a bolted refractory tile of the prior art.

Referring to the figures set forth in the accompanying Drawings, the illustrative embodiments of the present invention will be described in detail hereinbelow. For clarity of exposition, like features shown in the accompanying drawings shall be indicated with like reference numerals and similar features as shown in alternate embodiments in the Drawings shall be indicated with similar reference numerals.

Where used in this disclosure, the term "axial" when used in connection with an element described herein, shall refer to a direction relative to the element, which is substantially parallel to the central axis a of tube 18 (i.e., FIG. 7) when the element is disposed in engagement with a tube 18 as shown in FIGS. 6, 7, 10 and 14. The term "transverse" refers to a direction substantially orthogonal to the axial direction.

Figure 6:
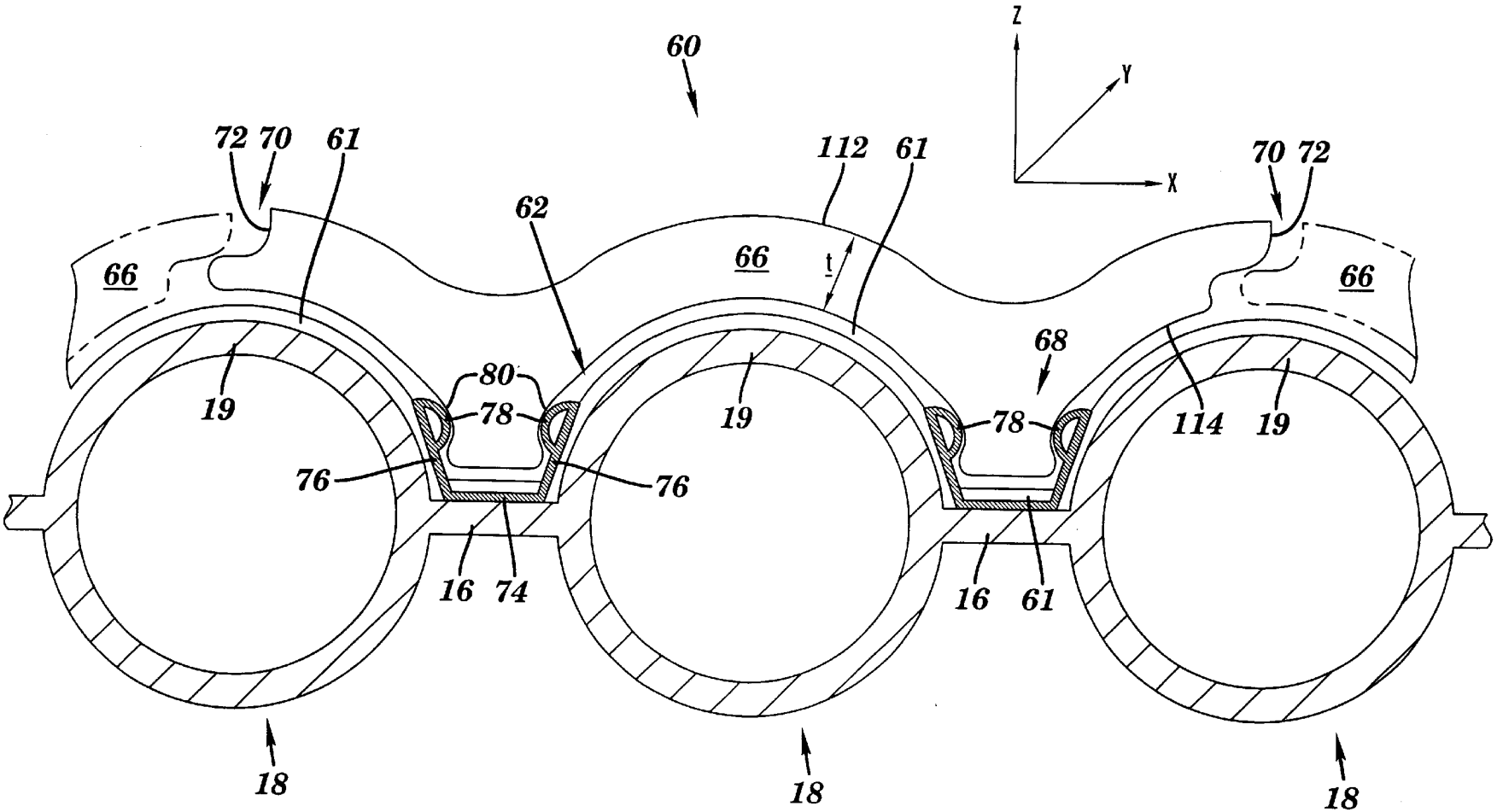
FIG. 6 is a view similar to that of FIG. 2, including a top elevational view of an embodiment of the refractory tile system of the present invention.

Turning now to FIG. 6, in one embodiment of the present invention, a refractory tile system 60 includes a barrier layer coating 61 applied to the wall 62 (i.e., membrane 16 and tube wall 19) of a boiler of an incinerator or heat exchanger. The barrier layer 61 is adapted to provide acid and salt corrosion resistance at the normal operating temperatures of the boiler. An example of such a coating is a phosphate bonded SiC barrier layer such as PC-1022™ available from Norton Company of Worcester, Mass. Advantageously, this material provides relatively good corrosion resistance and thermal conductivity. Refractory tiles 66 are then fastened to the tube wall 62 in superposed relation with the wall 62 utilizing a floating attachment mechanism 68. The tiles 66 are fabricated from any suitable refractory material known to those skilled in the art, such as, for example silicon carbide (SiC) or other ceramic materials capable of withstanding the temperatures (as high as approximately 1400° C.) experienced within the boiler of a MSW incinerator/heat exchanger, and the like.

Figure 9:
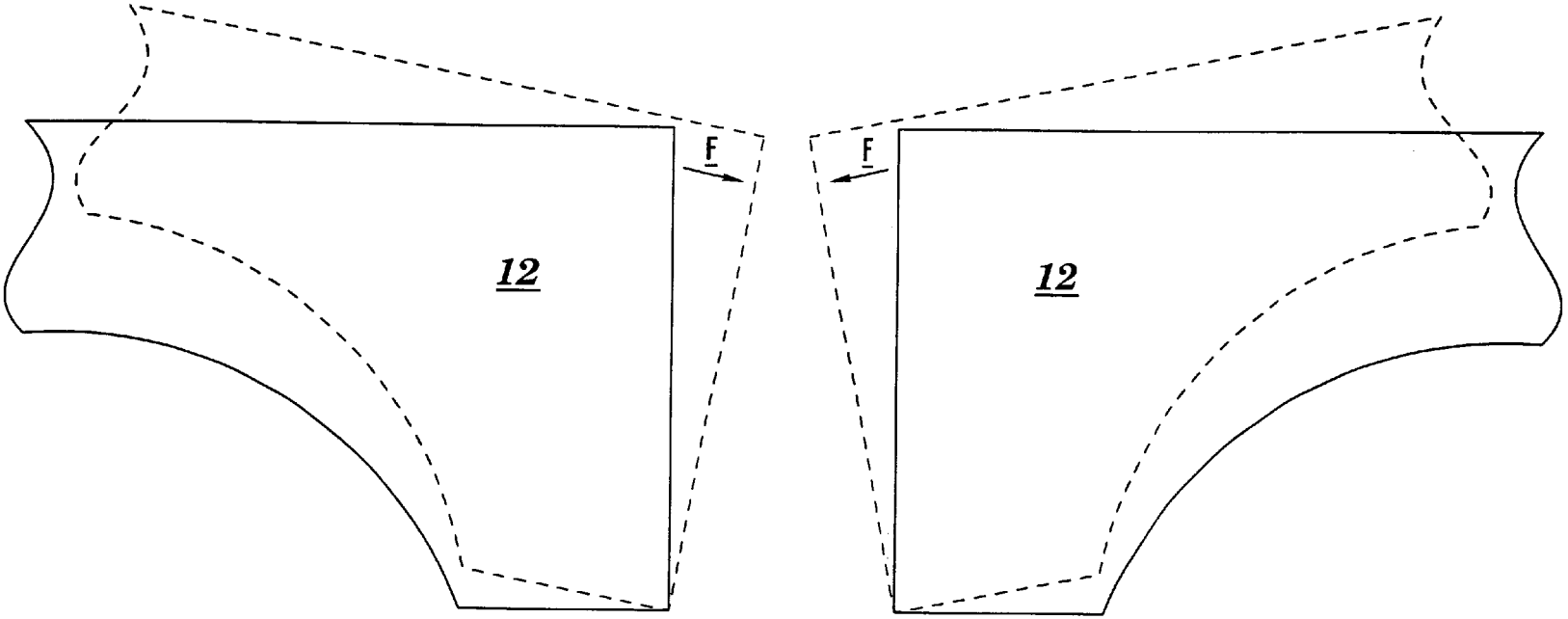
FIG. 9 PRIOR ART
FIG. 9 is a schematic cross-sectional view similar to that of FIG. 2, of a portions of a pair of adjacent refractory tiles of the prior art, with portions shown in phantom to indicate improvement due to bowing.

The floating attachment mechanism 68 provides the tiles 66 with a relatively high degree of freedom of movement relative to the tube wall 62 to accommodate micro-scale bowing of the tile. As discussed hereinabove, the micro-scale bowing has been found to be generated by the relatively large temperature gradient (typically about 200 to 600° C. or more) experienced by such tiles. As also discussed, this temperature gradient has been found to have a substantially greater effect on the dimensional instability of the tiles than the elevated temperature per se, particularly in light of the networking effect in which bowing increases as a square of length of the tile array. Each tile 66 is effectively isolated from adjacent tiles by providing a predetermined gap 70 therebetween of sufficient size to effectively prevent macro-scale bowing which has been found to be generated by networking. As shown in FIG. 9, this networking phenomena is generated by the pressure or force F exerted by the tiles upon one another through the rigid mortar (not shown) when micro-scale bowed.

Turning back to FIG. 6, the gap 70 is preferably formed by contoured peripheral edges 72 which are sized and shaped to form a spaced, shiplapped joint between adjacent tiles 66. This shiplapped configuration advantageously serves to provide an obstructed line-of-sight between the tiles to inhibit penetration of ash or other contaminants through the gap 70 during operation of the boiler. Moreover, a compressible fibrous mortar (not shown) may be disposed in the gap or channel 70 between each adjacent tile to further inhibit ash or other contaminant penetration. An example of such a suitable compressible fibrous mortar is known as Topcoat 2600™ available from Unifrax Corporation of Niagara Falls, N.Y. In the event such a compressible mortar is used, the gaps 70 are sized in combination with the known compressibility of the particular compressible mortar selected, so as to maintain any force transfer between tiles at a magnitude low enough to substantially prevent the occurrence of macro-scaled bowing when the individual tiles are disposed in their maximum micros scale bowed condition. For example, tiles shaped substantially as shown in FIG. 7 having a rectangular face 112' extending approximately 30 cm×20 cm, should have gaps 70' extending at least approximately 6 mm from adjacent tiles.

In the embodiment shown, floating attachment mechanism 68 includes rails 74 having a plurality of flexible arms 76 with convex terminal ends 78 adapted to engage similarly sized recesses 80 disposed in the tiles 66. Arms 76 are thus biased into releasable engagement with tile 66 to facilitate installation and removal thereof. Moreover, the resiliency of the arms 76 serves to fasten the tile 66 to the wall 62 in a manner which permits the tile 66 to move or "float" relative to the wall 62 in response to dimensional changes of the tile 66 generated by thermal gradients and elevated mean temperatures. In this regard, the floating attachment mechanism 68 enables the tile 66 to move with at least three degrees of freedom (i.e., along three mutually orthogonal axes x, y and z, as shown) relative to the wall 62. Moreover, in addition to translation along the x, y and z axes, the tile may rotate around a tube 18 and/or bow towards or away from a tube 18. The rail 74, including arm 76 and convex terminal end 78 are preferably fabricated from a flexible, corrosion resistant material, such as stainless steel.

As also shown, the face 112 of the tile 66 may be provided with a contoured geometry which substantially matches the contour of the wall 62 to provide the tile with a relatively uniform thickness t.

Figure 7:
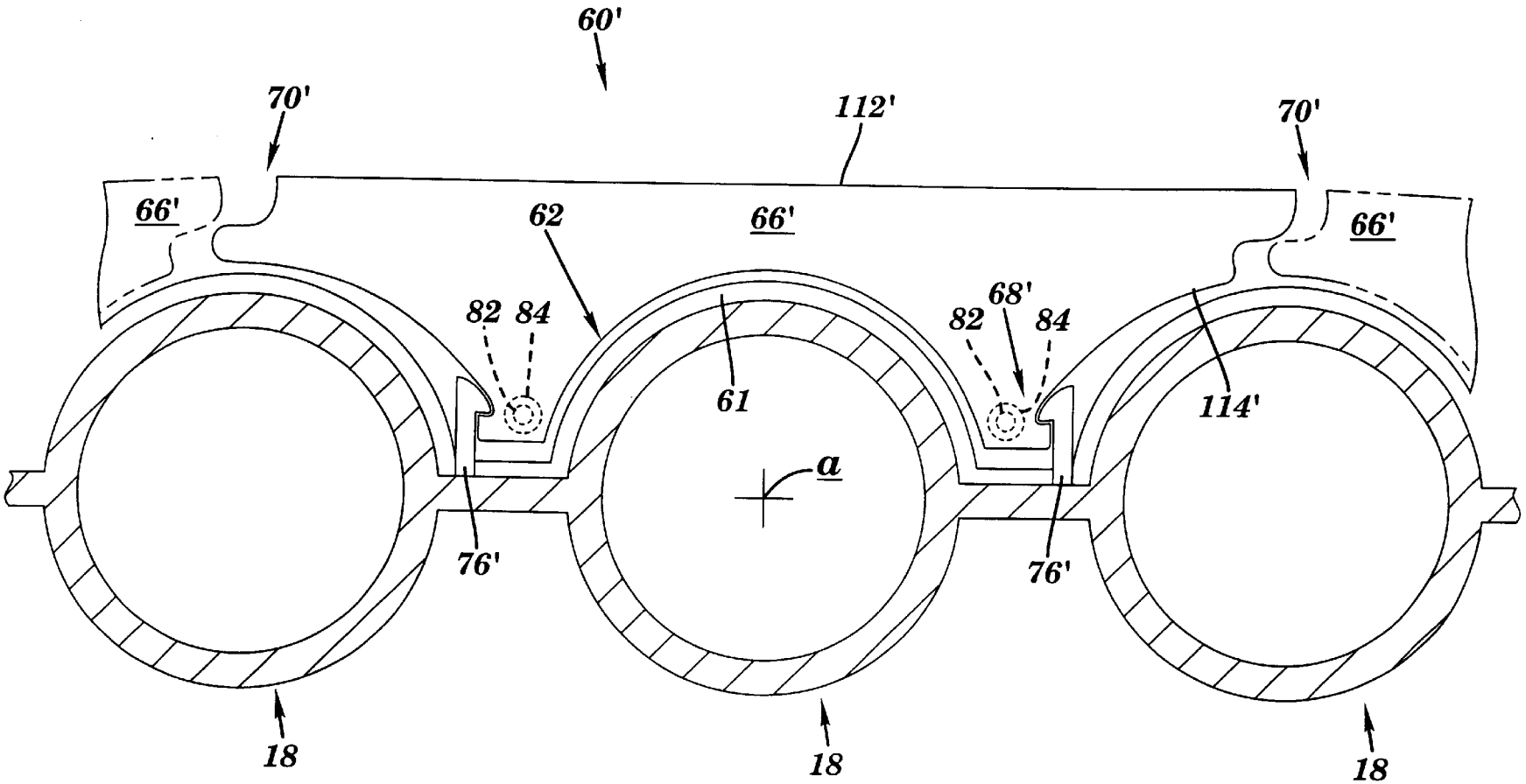
FIG. 7 is a view similar to that of FIG. 6, of an other embodiment of the refractory tile system of the present invention.
Figure 8:
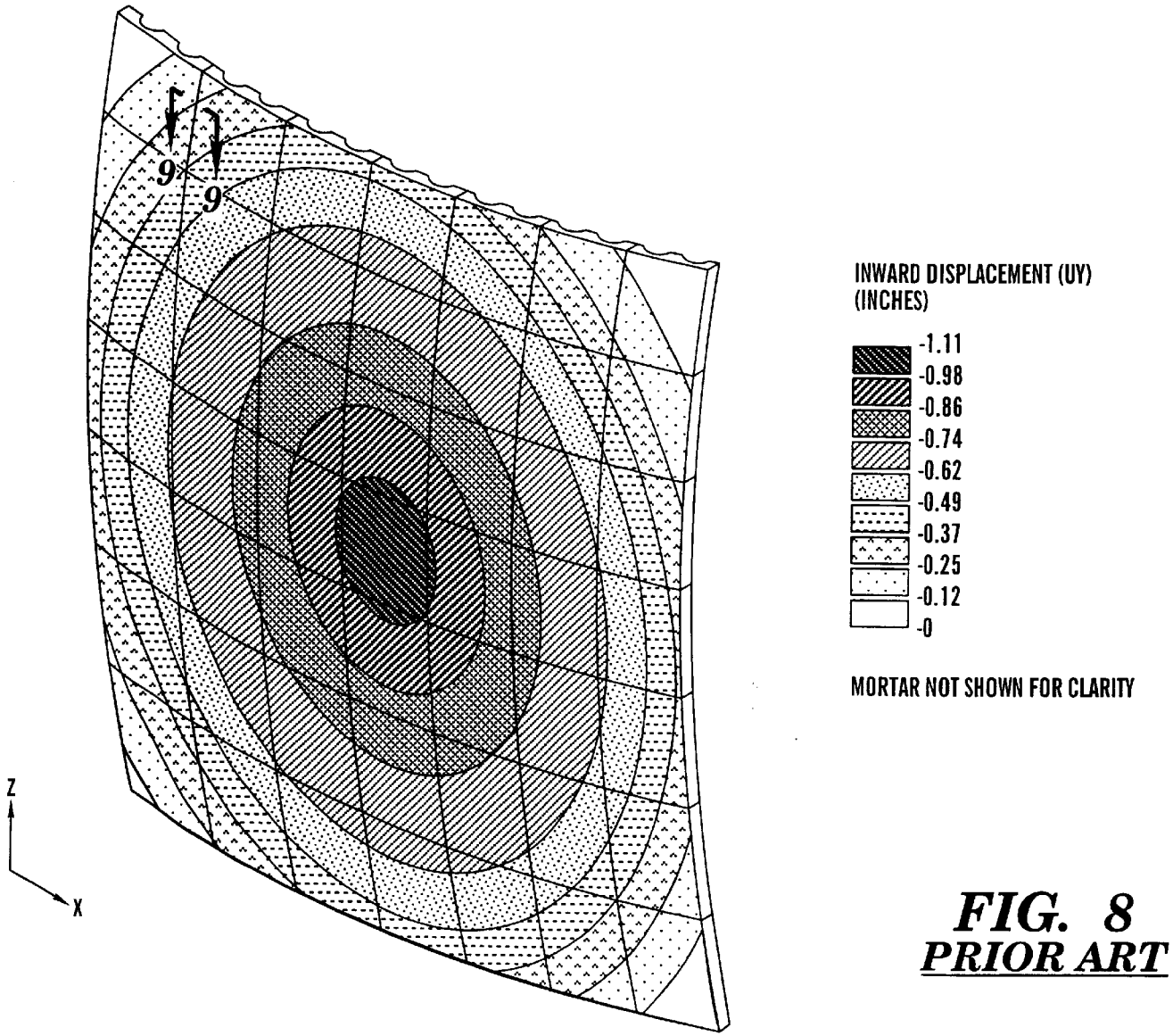
FIG. 8 PRIOR ART
FIG. 8 is a perspective view of an array of prior art refractory tiles bowed on a macro-scale as identified pursuant to the present invention.

Turning now to FIG. 7, an alternate embodiment of the present invention is shown as tile system 60'. This embodiment is substantially similar to the tile system 60 shown in FIG. 6, while utilizing a substantially planar face 112' and an alternate floating engagement mechanism 68'. As shown, this fastener system 68' is in many respects similar to fastener system 68 of FIG. 6, though utilizing approximately 50 percent fewer arms 76'.

Although embodiments of floating mechanism 68 and 60' have been shown, it should be recognized by those skilled in the art that substantially any mounting mechanism capable of securing a tile to a wall 62 of a boiler in a manner which permits the tile to expand and/or bow on a micro-scale without generating the macro-bowing effect as set forth hereinabove, may be utilized without departing from the spirit and scope of the present invention. In this regard, for example, a rigid mounting arrangement may be used in lieu of the flexible arms 76 and 76', as long as sufficient clearance is provided between the mounting hardware and the tile to enable the aforementioned dimensional changes to occur nominally without applying excessive force or stress to the mounting hardware and/or adjacent tiles.

One example of such an alternate arrangement may include provision of one or more pins 82 (shown in phantom) fabricated from stainless steel or the like, which are insertable into substantially oversized bores 84 (shown in phantom) disposed within in the tile and which extend substantially parallel to the tile face 112. The pin 82 is in turn, secured to the wall 62 in any convenient manner known to those skilled in the art, (not shown). In this manner, the tile may be secured to the wall 62 with sufficient clearance to effectively "float" relative to the wall as discussed hereinabove.

Figure 10:
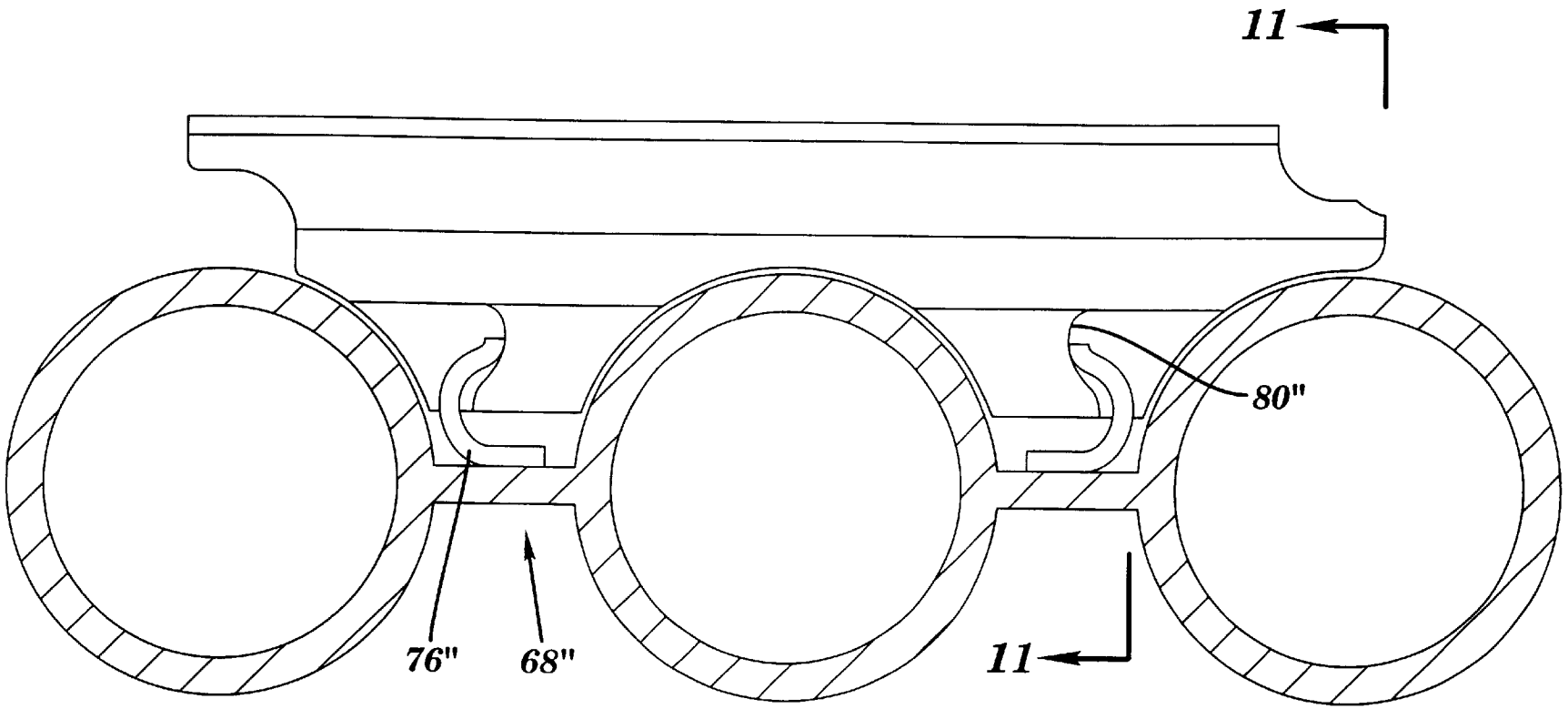
FIG. 10 is a view similar to that of FIGS. 6 and 7, of still another embodiment of the refractory tile system of the present invention.
Figure 11:
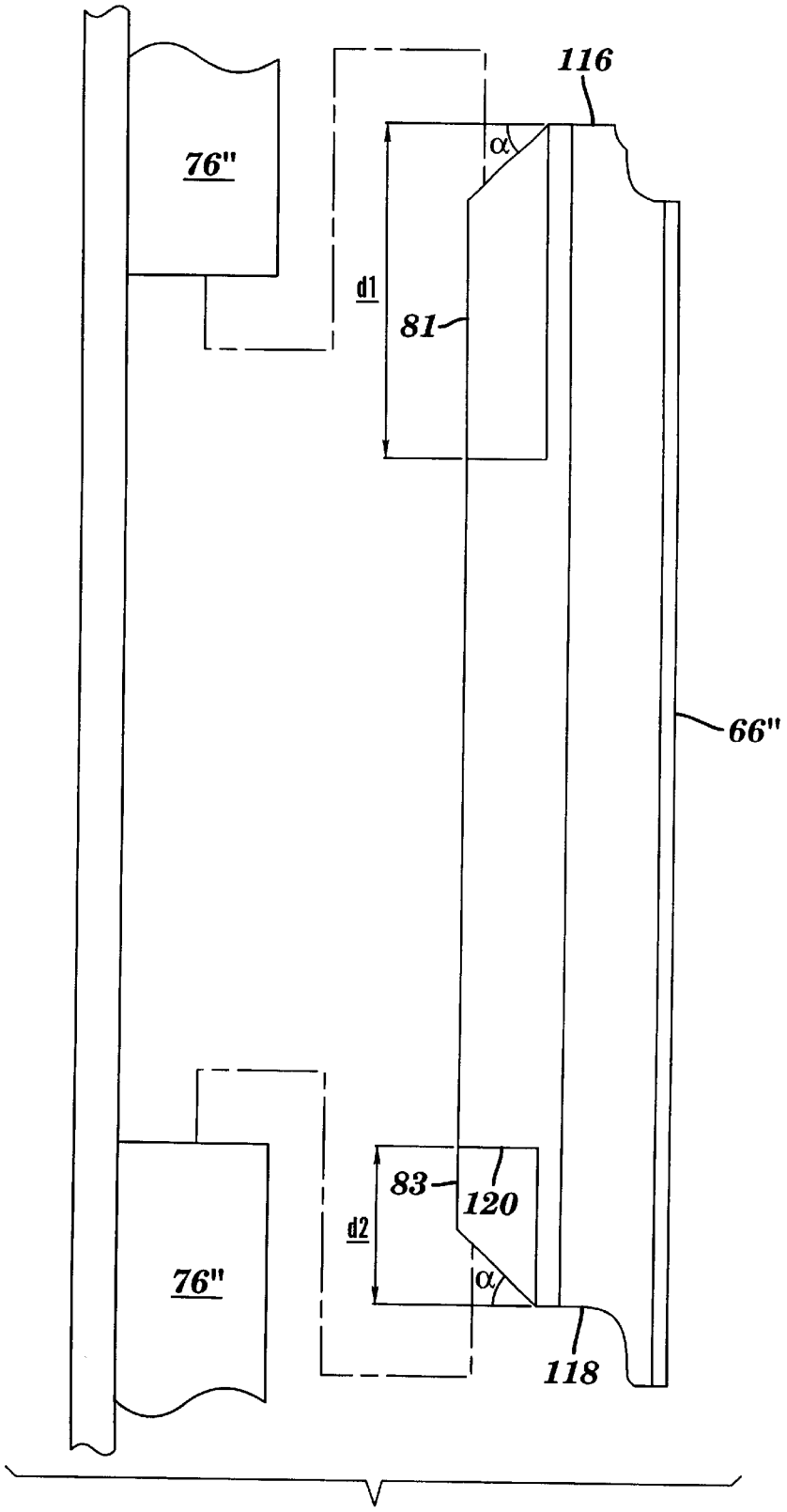
FIG. 11 is a side elevational exploded view of portions of the refractory tile system of FIG. 11.

Turning now to FIGS. 10 and 11, an additional embodiment of the present invention is shown as tile system 60". This tile system 60" is substantially similar to the tile systems 60 and 60' shown in FIGS. 6 and 7, while using an alternate floating engagement mechanism 68". As shown, this fastener system 68" is in many respects similar to fastener system 68' of FIG. 7, though the arms 76" are substantially "C" shaped for engagement with substantially semi-cylindrical slots or recesses 80" of the tile 66" as shown.

Referring to FIG. 11, the slots 80" of tile 66" include upper slots 81 and lower slots 83, which extend axially inward from upper and lower edges 116 and 118, respectively, of tile 66". The upper slot 81 preferably extends an axial distance d1 from upper edge 116 that is greater than axial distance d2 of lower slot 83, to facilitate installation of the tile 66" as discussed hereinbelow. As also shown, the upper and lower surfaces 116 and 118 are chamfered, preferably at an angle a of approximately 30 to 60 degrees, at their intersection with the slots 81 and 83 to further facilitate installation of the tiles 66" as discussed below. In a preferred embodiment, angle a is approximately 45 degrees as shown.

Figure 12:
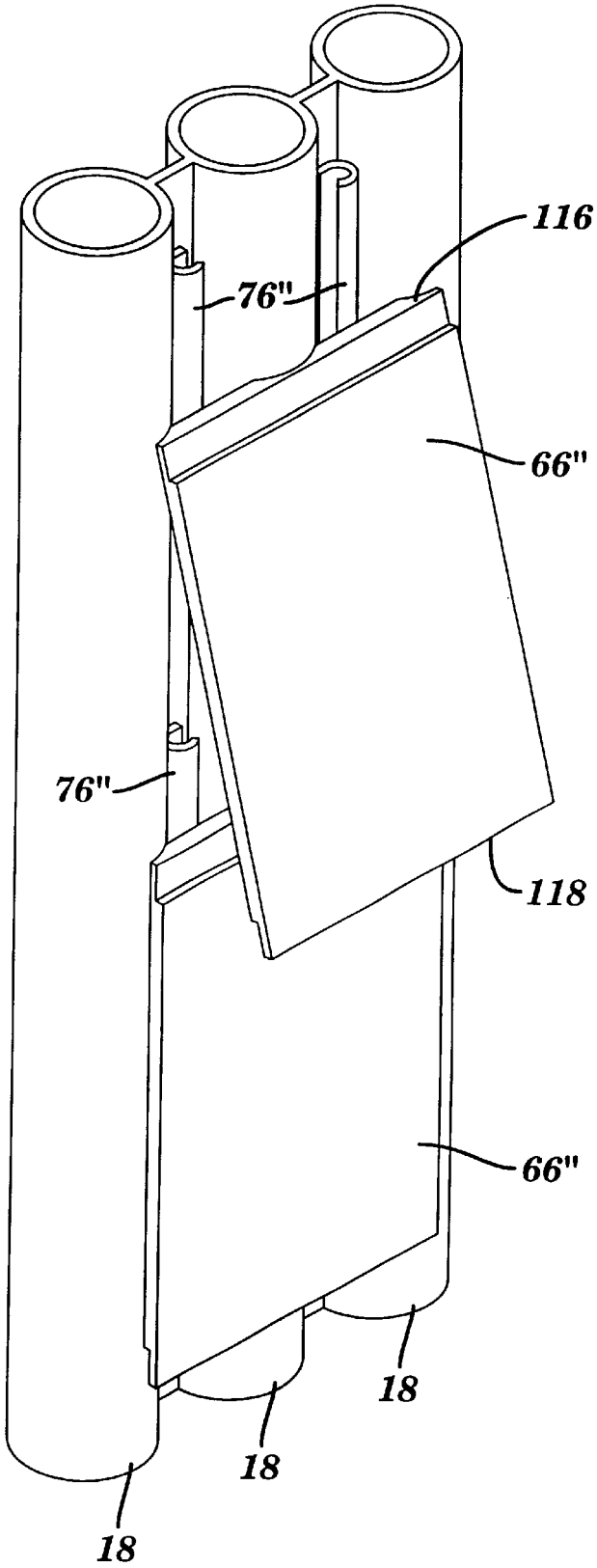
FIGS. 12–15 are perspective views of the refractory tile system of FIGS. 10 and 11, of various steps taken during installation of a refractory tile according to the present invention.
Figure 13:
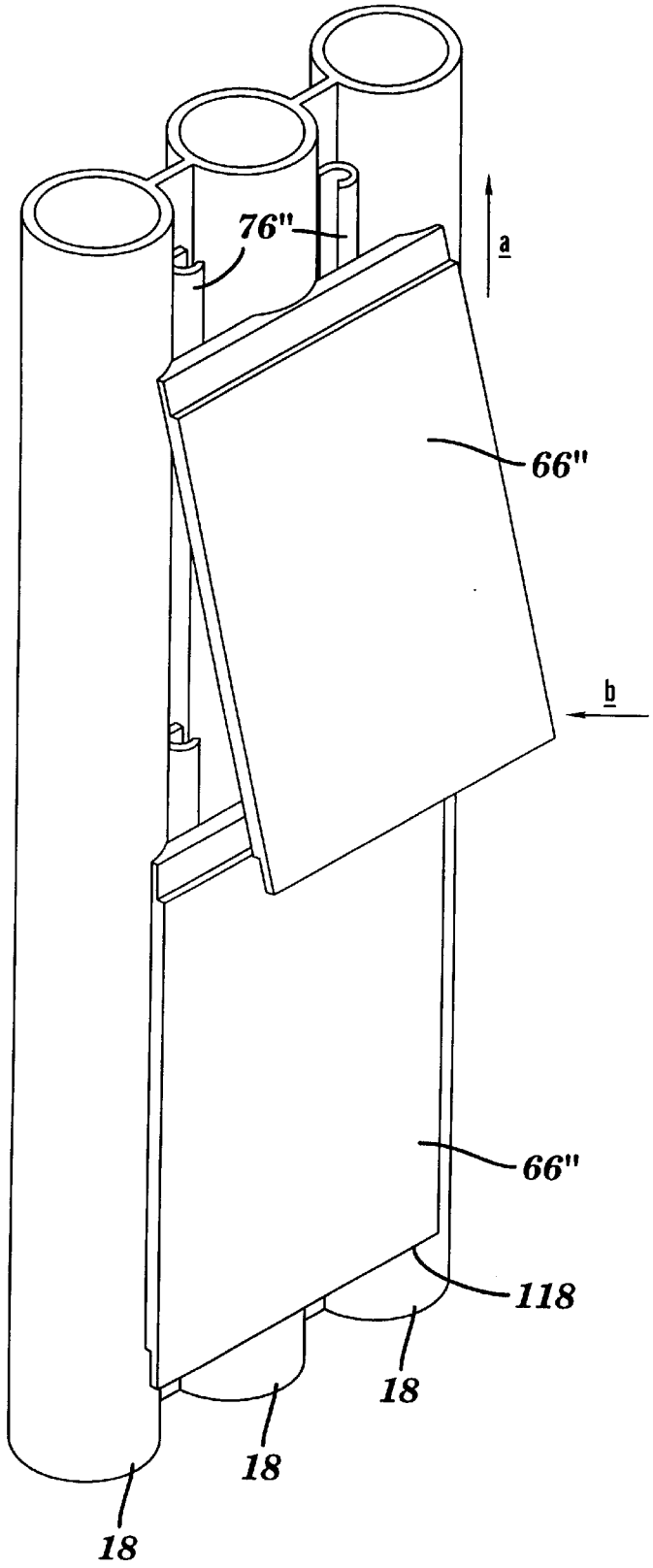
Figure 14:
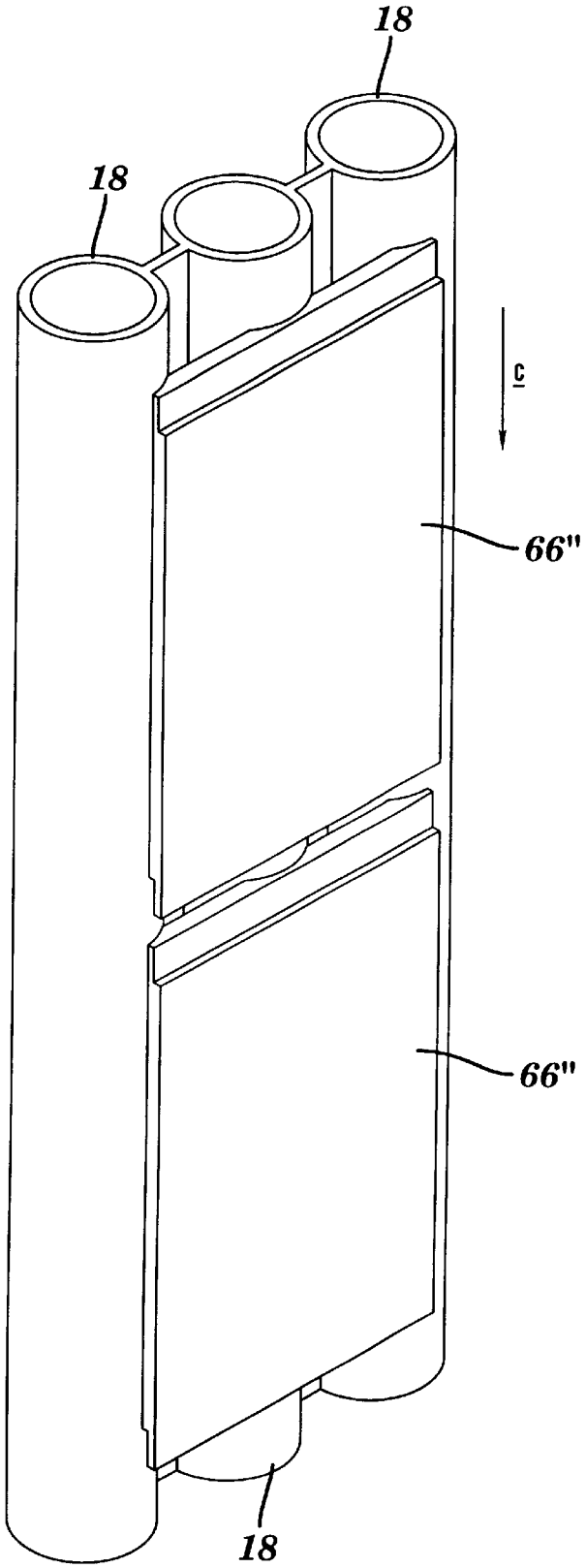
Figure 15:
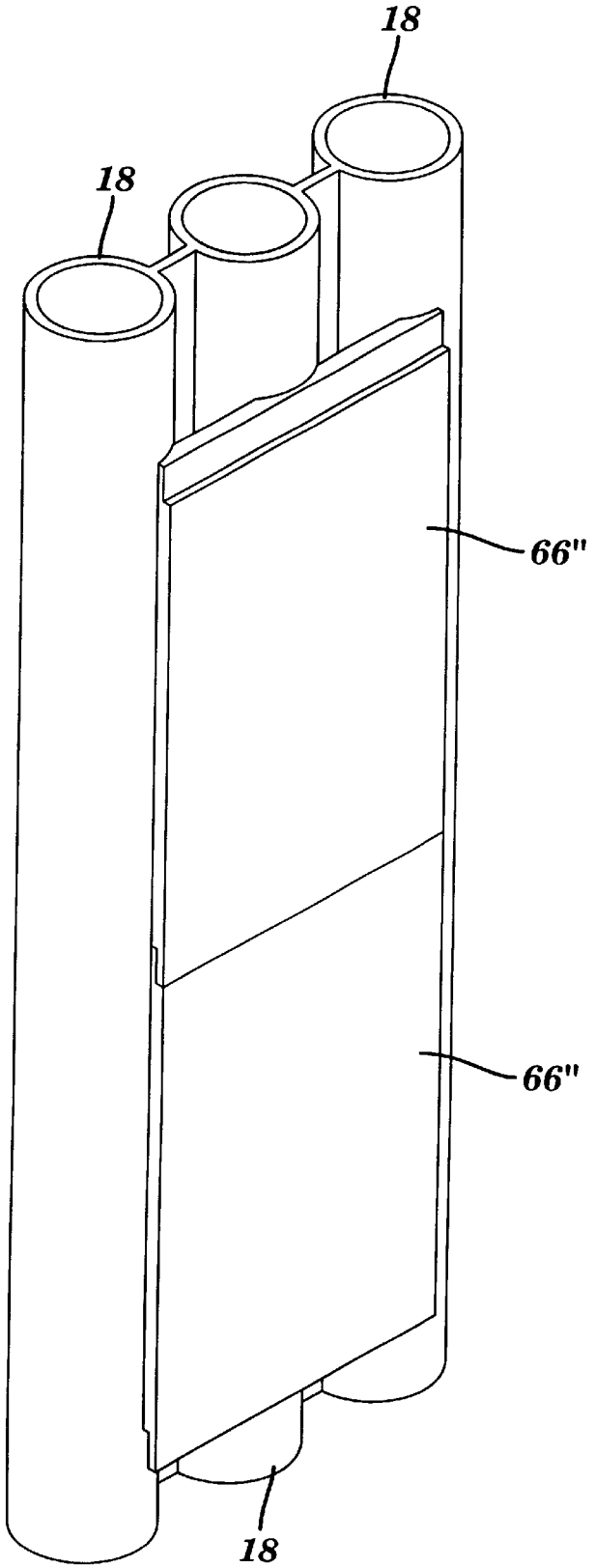

Turning now to FIGS. 12–15, the method of installing a tile 66" is shown. Referring to FIG. 12, a tile 66" is installed by placing the upper surface 116 of the tile between the upper and lower arms 76", in substantial axial alignment therewith. This orientation may be accomplished by disposing a portion of the upper surface 116 in surface-to-surface engagement with the tubes 18 as shown. Turning to FIG. 13, the surface 116 of tile 66" is moved axially upwards as indicated by arrow a, while the lower surface 118 is pivoted closer to the tubes 18 as shown by arrow b. This action serves to slide the upper slot 81 (FIG. 11) into receiving engagement with one set of (i.e., the uppermost) arms 76" as shown. This movement is continued until the tile clears the lower arms 76" to permit the tile 66" to be moved into substantially parallel alignment with the tubes 18 as shown in FIG. 14. The tile then may be translated axially towards an adjacent pre-installed tile 66" (i.e., in direction c) to receivably engage lower arms 76" within lower slots 83 (FIG. 11). This translation preferably continues until the lower arms 76" engage the proximal end 120 (FIG. 11) of the slots 83. At this point, the adjacent tiles 66" will be disposed in their desired spaced, shiplapped orientation as shown in FIG. 15, to complete the installation. Additional tiles 66" (not shown) then may be installed in a similar manner.

The following illustrative examples are intended to demonstrate certain aspects of the present invention. It is to be understood that these examples should not be construed as limiting.

EXAMPLES

Example 1—Comparison

Figure 2:
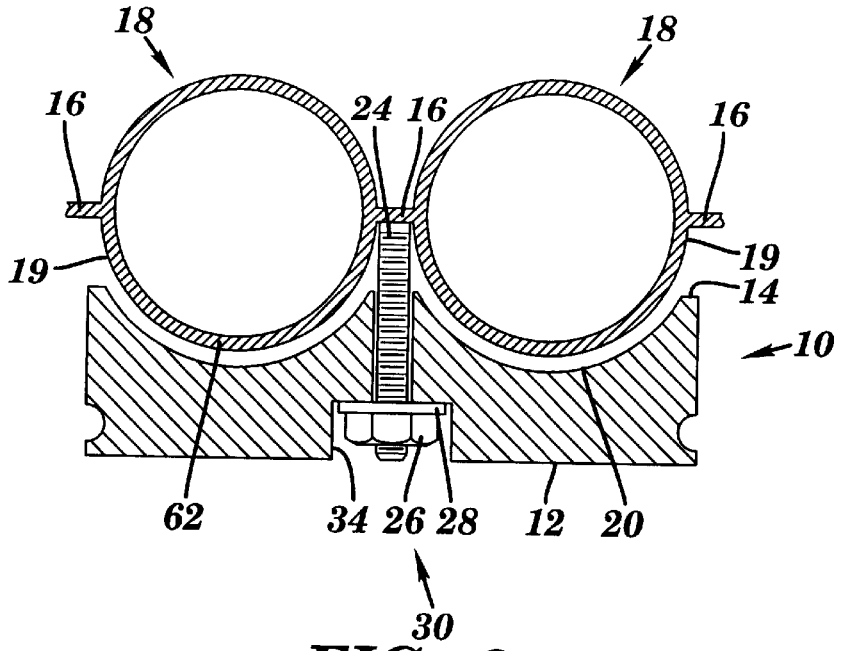
FIG. 2 PRIOR ART
FIG. 2 is a cross-sectional view taken along 2—2 of the refractory tile of FIG. 1.
Figure 3:
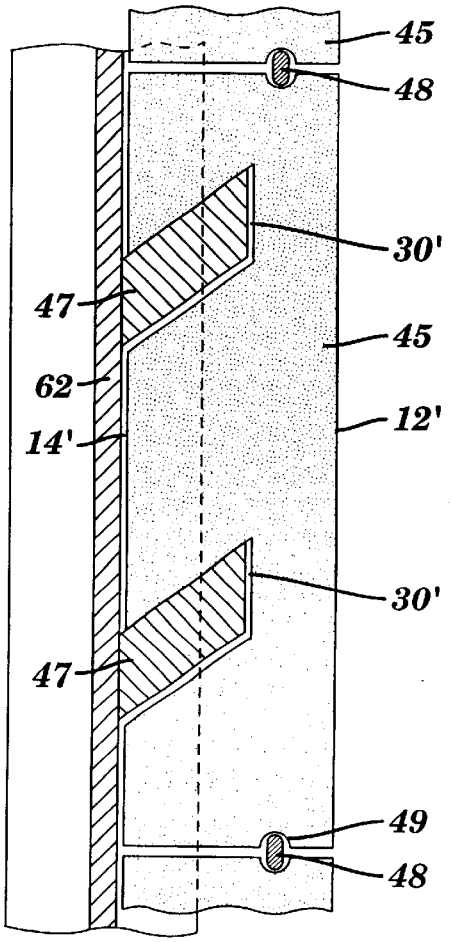
FIG. 3 PRIOR ART
FIG. 3 is a side elevational cross-sectional view of a hanging refractory tile of the prior art.
Figure 4:
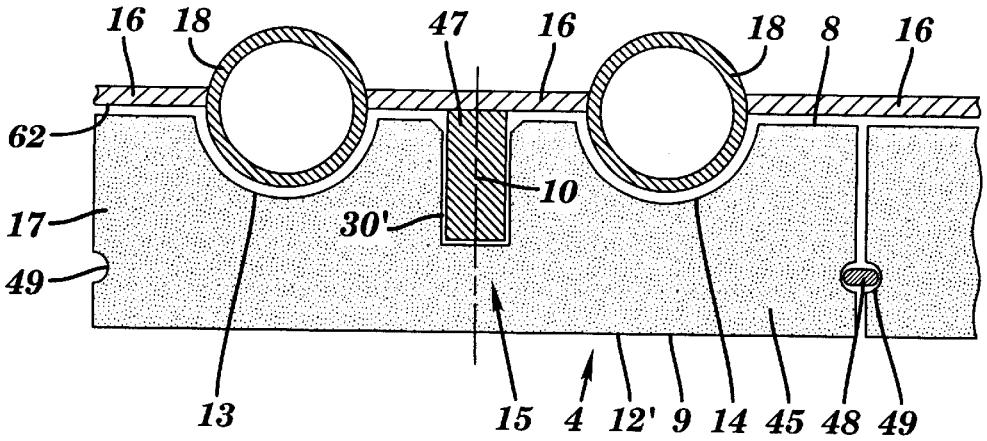
FIG. 4 PRIOR ART
FIG. 4 is a top elevational cross-sectional view of the hanging refractory tile of FIG. 3.
Figure 5:
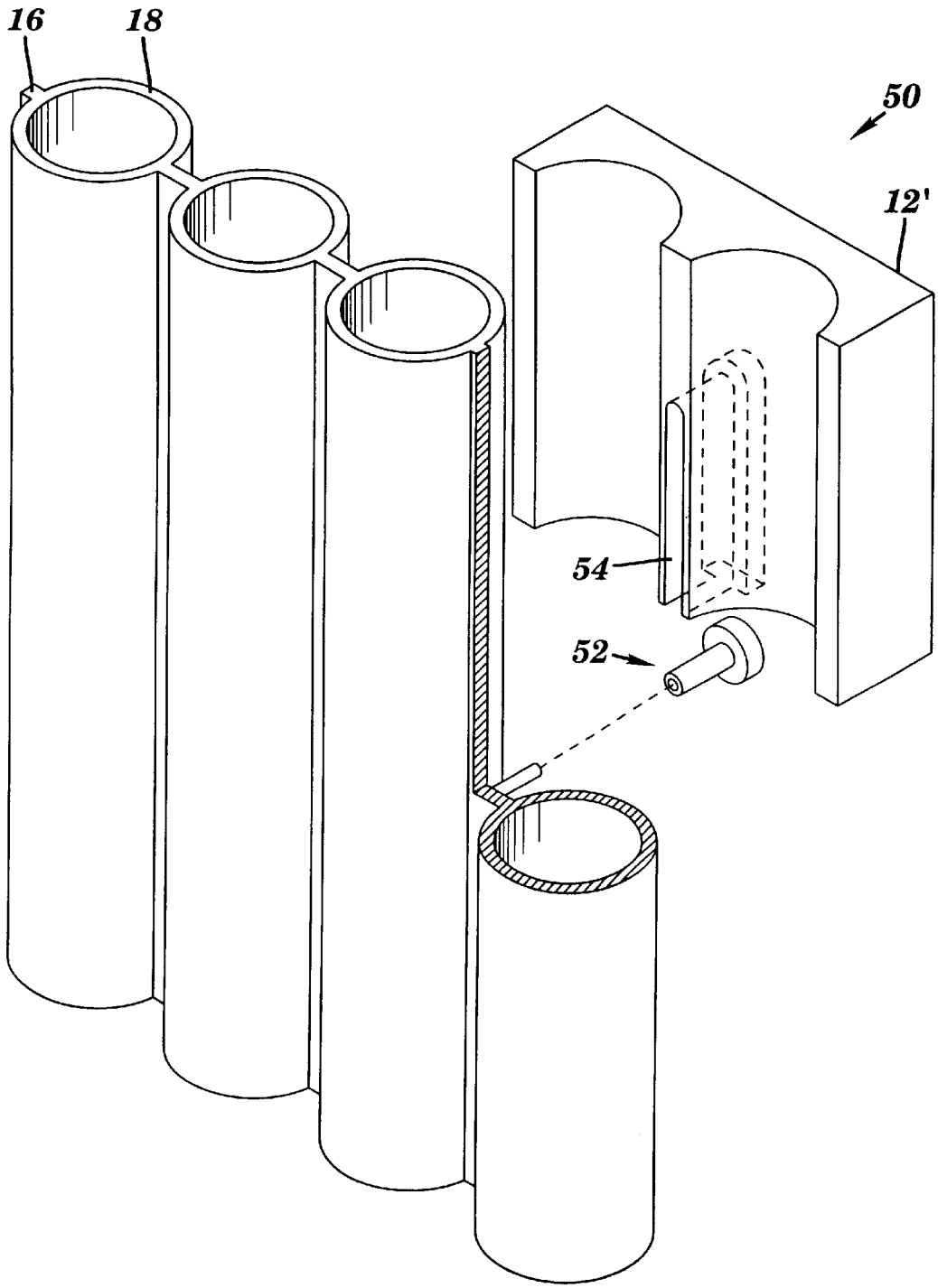
FIG. 5 PRIOR ART
FIG. 5 is a perspective, partially exploded view, with portions broken away, of a modified refractory tile of the prior art, disposed for engagement with a boiler wall.
Figure 16:
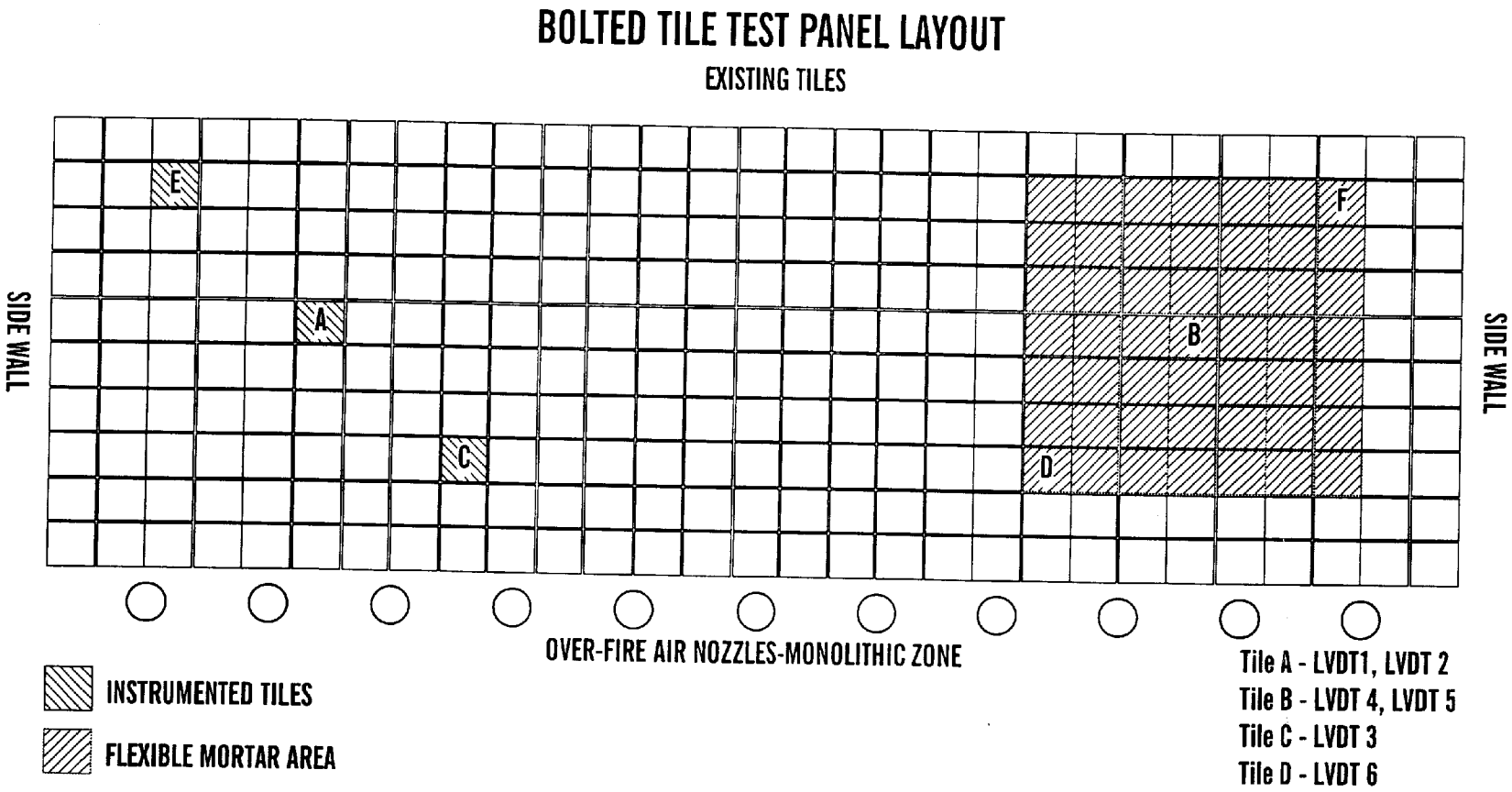
FIG. 16 is an elevational schematic representation of a series of conventional bolted tiles of FIGS. 1 and 2 installed in a boiler for test.
Figure 17:
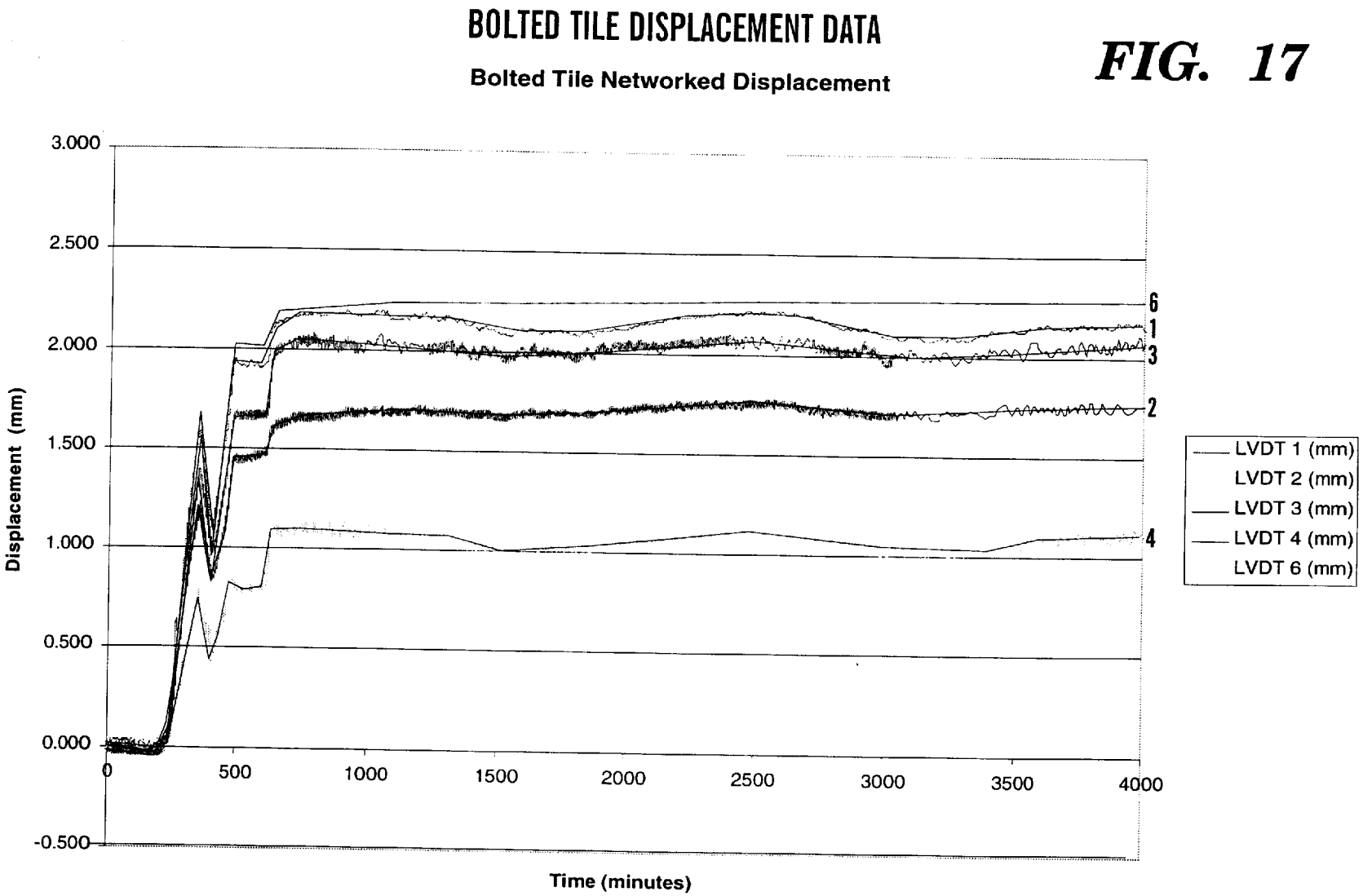
FIG. 17 is a graphical representation of test results generated by bolted tiles of FIG. 16.
Figure 18:
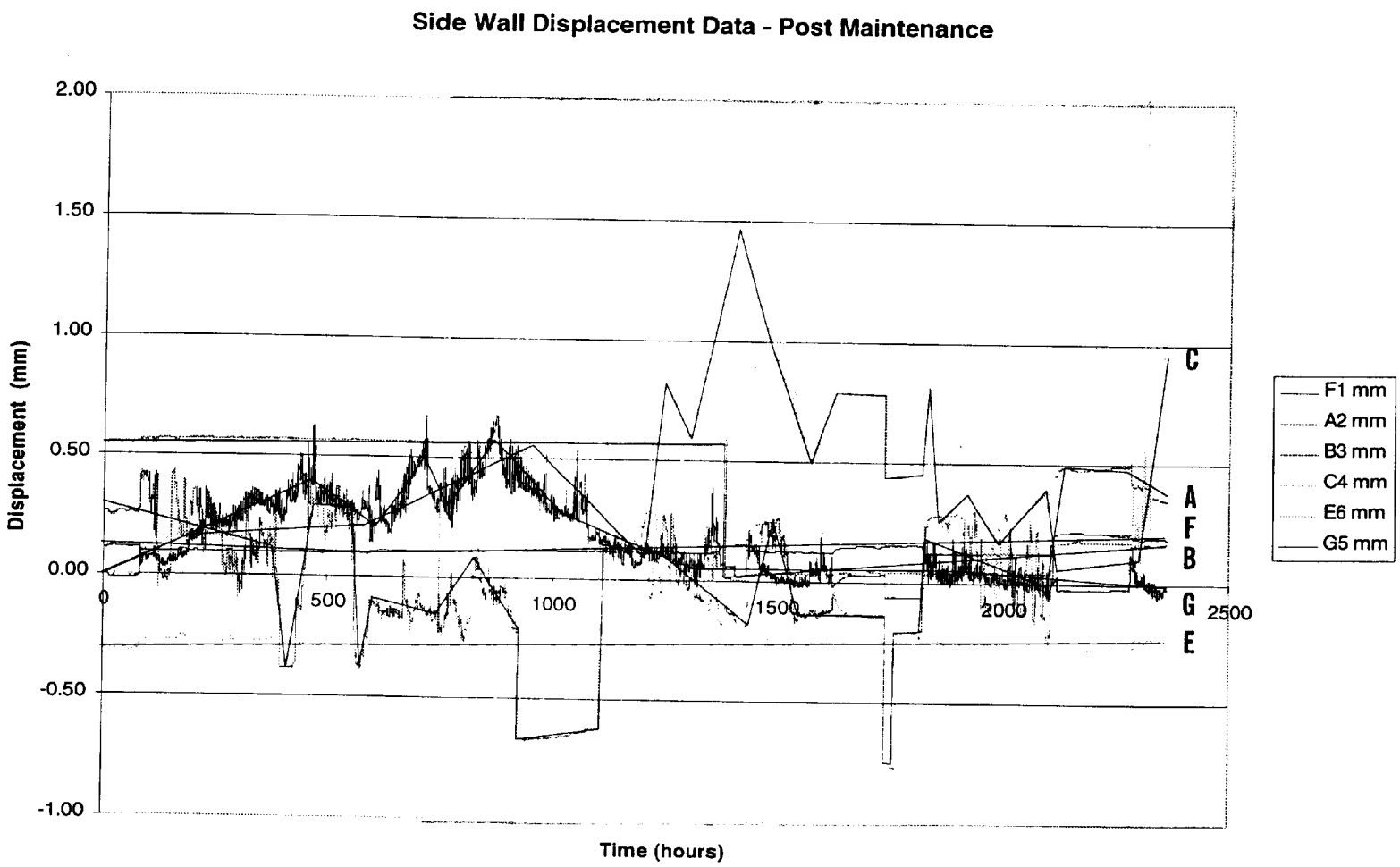
FIG. 18 is a graphical representation similar to that of FIG. 17, of test results generated by tiles of the present invention.

A series of conventional bolted tiles of the general type shown in FIGS. 1 and 2 were installed in a furnace in a pattern as shown in FIG. 16. Tiles labeled A, B, C, and D were instrumented with LVDTs (linear variable-displacement transducers) to measure the displacement of these tiles away from the tube walls during normal furnace operation. As shown, tiles B and D were located in a tile array portion that included a conventional flexible mortar (the above-referenced Topcoat 2600™) between adjacent tiles. Turning to FIG. 17, the output of the LVDTs indicate that the instrumented tiles were displaced nearly simultaneously with one another, providing evidence that macroscale bowing was taking place. (The differences in displacement magnitude indicated by the plots were apparently due to variations in location of the LVDTs within the tiles.) Note, LVDT 5 located on Tile B malfunctioned and thus is not shown in FIG. 17.

Example 2

An array of tiles of the present invention was mounted in a boiler for test. The tiles were configured and mounted in the boiler in a manner substantially as shown and described hereinabove with respect to FIG. 7, including use of a barrier material between the boiler wall and the tiles, and Topcoat 2600™ between adjacent tiles. Selected tiles indicated as A, B, C, D, E, and G were instrumented with LVDTs in the manner described in Example 1. As shown in FIG. 17, the output of these LVDTs show that the tiles were displaced independently from one another, in a manner contrary to that shown in Example 1. These test results thus indicate that these tiles of the present invention accommodated individual (micro-scale) bowing, without generating macroscale bowing.

Although the attachment mechanisms 68, 68' and 68" enable the tiles 66, 66' and 66" to move or "float" relative to the wall 62, the skilled artisan will recognize that the mechanisms 68, 68' and 68" preferably maintain the tile 66 as close as possible to the surface of the tube 18 to maximize heat transfer through the tile 66 to the tube.

Moreover, the aforementioned hanging tile and modified hanging tile systems discussed hereinabove may be utilized in combination with the present invention. Furthermore, a conventional bolted tile fastener arrangement as also discussed hereinabove may be modified to provide additional clearance between the stud and bore to permit the tile to float relative to the wall to thus be usable in combination with the corrosion barrier and the gap between adjacent tiles of the present invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. A refractory tile system for use on a wall of a boiler, the system comprising:

a plurality of tiles having a floating fastener system engagable with the wall to maintain said tiles in spaced, movable relation to one another;

said tiles being sized and shaped to provide a gap between adjacent ones of said tiles, said gap being sufficient to accommodate dimensional changes of said tiles exhibited during exposure to operational temperatures of the boiler; and a corrosion barrier fluid disposed between said tiles and the wall, said corrosion barrier fluid comprising a coating applied to the wall and adapted to adhere to the wall while being free from adherence to the tiles.

2. The refractory tile system of claim 1, wherein said fastener system maintains said tiles in spaced, moveable relation to the wall.

3. The refractory tile system of claim 2, wherein said tiles are sized and shaped to provide a gap between at least a portion of said tiles and the tube wall sufficient to accommodate said dimensional changes.

4. The refractory tile system of claim 1, wherein said gaps are sufficient to accommodate dimensional changes of said tiles due to exposure to a temperature gradient and exposure to a mean temperature experienced during operation of the boiler.

5. The refractory tile system of claim 4, wherein said temperature gradient is within a range of about 200–600 degrees C and said mean temperature is within a range of about 500 to 1400 degrees C.

6. The refractory tile system of claim 5, wherein said tiles are maintained close enough to the wall of the boiler to maintain said temperature gradient within said range of about 200–600 degrees C.

7. The refractory tile system of claim 6, wherein at least a portion of said tiles is maintained in superimposed contact with at least a portion of said corrosion barrier, and said portion of said corrosion barrier is maintained in superimposed contact with at least a portion of the wall.

8. The refractory tile system of claim 1, wherein said floating fastener system comprises an arm disposed on one of said wall and said tiles, and a receptacle disposed on an other of said wall and said tiles, said member and said receptacle being adapted for mutual engagement with sufficient clearance to maintain said tiles in said moveable relation.

9. The refractory tile system of claim 8, wherein said floating fastener system comprises a hanging tile system.

10. The refractory tile system of claim 8, wherein said floating fastener system comprises a T-slotted tile system.

11. The refractory tile system of claim 8, wherein said receptacle comprises at least one slot, said at least one slot extending in an axial direction.

12. The refractory tile system of claim 11, wherein said at least one slot extends inwardly from an edge of said tile, said edge being chamfered relative to the edge of said tile.

13. The refractory tile system of claim 12, wherein said at least one slot comprises first and second slots extending inwardly from opposite edges of said tile, said first slot extending approximately twice as far as said second slot from respective opposite edges.

14. The refractory tile system of claim 12, wherein said chamfer extends approximately 30 to 60 degrees relative to a transverse direction.

15. The refractory tile system of claim 1, wherein said floating fastener system provides said tiles with at least one degree of freedom of movement relative to the wall.

16. The refractory tile system of claim 15, wherein said floating fastener system provides said tiles with at least two degrees of freedom of movement relative to the wall.

17. The refractory tile system of claim 16, wherein said floating fastener system provides said tiles with at least three degrees of freedom of movement relative to the wall.

18. The refractory tile system of claim 1, further comprising a compressible material disposed in said gap.

19. The refractory tile system of claim 18, wherein said compressible material inhibits passage of contaminants into said gap.

20. The refractory tile system of claim 19, wherein said compressible material comprises a fibrous mortar.

21. The refractory tile system of claim 1, wherein said coating comprises a membrane.

22. The refractory tile system of claim 21, wherein said coating comprises phosphate bonded silicon carbide (SiC).

23. The refractory tile system of claim 1, wherein said tiles further comprise peripheral surfaces sized and shaped to form a spaced, shiplapped joint between said adjacent ones of said tiles.

24. The refractory tile system of claim 5, wherein said mean temperature is within a range of about 750 to 1200 degrees C.

25. A refractory tile system for use on a wall of a boiler, the system comprising:

a plurality of tiles disposed on the wall in spaced, movable relation to one another;

said tiles being sized and shaped to provide a gap between adjacent ones of said tiles, the gap being sufficient to substantially prevent macro-scale bowing of said tiles during exposure to operational temperatures of the boiler; and a corrosion barrier fluid disposed between said tiles and the wall to substantially prevent corrosion of the wall, said corrosion barrier fluid comprising a coating applied to the wall and adapted to adhere to the wall while being free from adherence to the tiles.

26. A method for increasing the useful life of a wall of a boiler, said method comprising the steps of:

(a) providing a plurality of tiles having a floating fastener system engagable with the wall to maintain said tiles in spaced, movable relation to one another;

(b) sizing and shaping said tiles to provide a gap between adjacent ones of said tiles, said gap being sufficient to accommodate dimensional changes of said tiles exhibited during exposure to operational temperatures of the boiler;

(c) disposing a corrosion barrier fluid on the wall, said corrosion barrier fluid comprising a coating applied to the wall and adapted to adhere to the wall while being free from adherence to the tiles; and (d) engaging the floating fastener system with the wall, wherein the tiles are superposed with the wall and the corrosion barrier is disposed therebetween.

* * * * *